United States Patent [19]

Cummins

[11] 4,318,443

[45] Mar. 9, 1982

[54] FOAM GENERATING FIRE FIGHTING DEVICE

[76] Inventor: Mark A. Cummins, 305 Delmas, Lufkin, Tex. 75091

[21] Appl. No.: 181,716

[22] Filed: Aug. 27, 1980

Related U.S. Application Data

[63] Continuation of Ser. No. 933,595, Aug. 14, 1978, abandoned.

[51] Int. Cl.[3] ..... A62C 35/00

[52] U.S. Cl. ..... 169/15; 239/366

[58] Field of Search ..... 169/78, 9, 14, 15, 44; 239/373, 429, 366, 369, 368; 261/27, 35, 122; 252/359 E, 321

[56] References Cited

U.S. PATENT DOCUMENTS

| | | | |
|---|---|---|---|
| 639,024 | 12/1899 | Eggers | 239/366 |
| 1,753,429 | 4/1930 | Rice | 261/122 |
| 2,745,700 | 5/1956 | Phalen | 239/366 |
| 2,811,211 | 10/1957 | Eriksson | 169/14 |
| 2,842,465 | 7/1958 | Harrison | 134/7 |
| 2,860,856 | 11/1958 | Bauer | 259/4 |
| 2,908,334 | 10/1959 | Duggan et al. | 169/32 |
| 2,988,151 | 6/1961 | Dion-Biro | 169/14 |
| 2,990,885 | 7/1961 | Brazier | 169/1 |
| 3,122,327 | 2/1964 | Wiedorn | 239/431 |
| 3,234,962 | 2/1966 | Williamson | 137/565 |
| 3,337,195 | 8/1967 | Farison | 261/27 |
| 3,465,827 | 10/1966 | Levy et al. | 169/2 |
| 3,592,269 | 7/1971 | Stults | 169/9 |
| 3,979,326 | 7/1976 | Chatterton | 252/359 |

FOREIGN PATENT DOCUMENTS

| | | |
|---|---|---|
| 388858 | 8/1935 | Canada . |
| 506841 | 10/1954 | Canada . |
| 697028 | 11/1950 | United Kingdom . |
| 752984 | 8/1954 | United Kingdom . |
| 1051841 | 1/1964 | United Kingdom . |
| 1176377 | 3/1967 | United Kingdom . |

*Primary Examiner*—David A. Scherbel
*Assistant Examiner*—Kenneth Noland
*Attorney, Agent, or Firm*—Richards, Harris & Medlock

[57] ABSTRACT

An apparatus (10) for generating and discharging foam is provided. Apparatus (10) includes a container (12) for receiving and storing a foam generating solution (24). A discharge tube (66) is connected to container (12). An ejector tube (32) is disposed within container (12) for discharging the foam generating solution (24) to the discharge tube (66). Foam generating structure (34) is disposed between the ejector tube (32) and the discharge tube (66) exterior of the container (12) and includes a chamber (74) communicating with ejector tube (32) for permitting the passage of the foam generating solution (24) therethrough to the discharge tube (66). A pressure source (52) communicates with the container (12) for forcing the foam generating solution (24) through the ejector tube (32) and the foam generating structure (34). The pressure source (52) further communicates with the chamber (74) for aerating the foam generating solution (24) prior to flowing through the discharge tube (66).

9 Claims, 2 Drawing Figures

FOAM GENERATING FIRE FIGHTING DEVICE

This is a continuation of application Ser. No. 933,595, filed Aug. 14, 1978, now abandoned.

TECHNICAL FIELD

This invention relates to fire fighting equipment, and more particularly to a fire fighting foam generating device for introducing air into a foam generating solution.

BACKGROUND ART

In the past several years fire fighting techniques have included the use of applying a saponaceous or surfactant solution to burning material. These solutions are saturated with air to produce an abundance of bubbles turning the solution into a voluminous froth to smother the burning material and extinguish the fire. Typical foam generating devices are described and claimed in U.S. Pat. No. 1,753,429 issued to Rice on Apr. 8, 1930 and entitled "Apparatus for Producing Foam" and U.S. Pat. No. 2,908,334 issued to Duggan, et al on Oct. 13, 1959 and entitled "Process and Apparatus for Generating and Discharging Foam".

Such prior art foam generating devices have used specially designed complex and expensive nozzles for the introduction of air into the foaming agent and for agitating the air-foaming agent mixture to produce foam at the nozzle head. This technique requires a large amount of pressure to pump the foaming agent through the nozzle in addition to specially designed nozzles. Additionally, prior art foam generating devices include complex mechanical systems making them difficult to maneuver when fighting a fire and which are difficult and costly to maintain.

A need has thus arisen for a foam generating device that is simple in operation and is operable with a minimum amount of pressure to pump the foaming agent. Additionally, a need has arisen for a foam generating device in which the aeration and agitation of the foam generating solution are accomplished without the need of specially designed nozzles.

DISCLOSURE OF THE INVENTION

In accordance with the present invention, a foam generating device for aerating and agitating a foam generating solution is provided.

In accordance with the present invention, a foam generating device is provided for generating and discharging foam. The device includes a container for receiving and storing a foam generating solution. A discharge tube is connected to the container, and an ejector tube is disposed within the container for discharging the foam generating solution to the discharge tube. Foam generating structure is disposed between the ejector tube and the discharge tube exterior of the container and includes a chamber communicating with the ejector tube for permitting the passage of the foam generating solution therethrough to the discharge tube. A pressure generator communicates with the container for forcing the foam generating solution through the ejector tube and the foam generating structure. The pressure generator further communicates with the chamber for aerating the foam generating solution.

In accordance with another aspect of the present invention, an apparatus for generating and discharging fire extinguishing foam includes a container for receiving and storing a foam generating solution. A discharge tube is connected to the container, and an ejector tube is disposed within the container for discharging the foam generating solution to the discharge tube. An aeration chamber is provided and includes a plurality of apertures. The aeration chamber is disposed between the ejector tube and the discharge tube exterior of the container and is operable to permit the passage of the foam generating solution therethrough. A source of propellant is provided for introducing a propellant into the container for forcing the foam generating solution through the ejector tube and the aeration chamber. The propellant communicates with the aeration chamber apertures for introducing air into the flow of the foam generating solution to generate foam within the discharge tube.

In accordance with yet another aspect of the present invention, a method for producing foam from a foam generating solution includes the step of storing a foam generating solution in a container. A propellant is passed through the container to force the foam generating solution into a foam generating chamber. The foam is generated by aerating the foam generating solution within the chamber by passing a propellant through the chamber. The aerated foam is agitated within a foam discharge tube. The propellant further discharges the agitated foam from the discharge tube.

BRIEF DESCRIPTION OF DRAWINGS

A more complete understanding of the invention and its advantages will be apparent from the following Detailed Description taken in conjunction with the accompanying Drawings in which.

DETAILED DESCRIPTION

Figure 1:
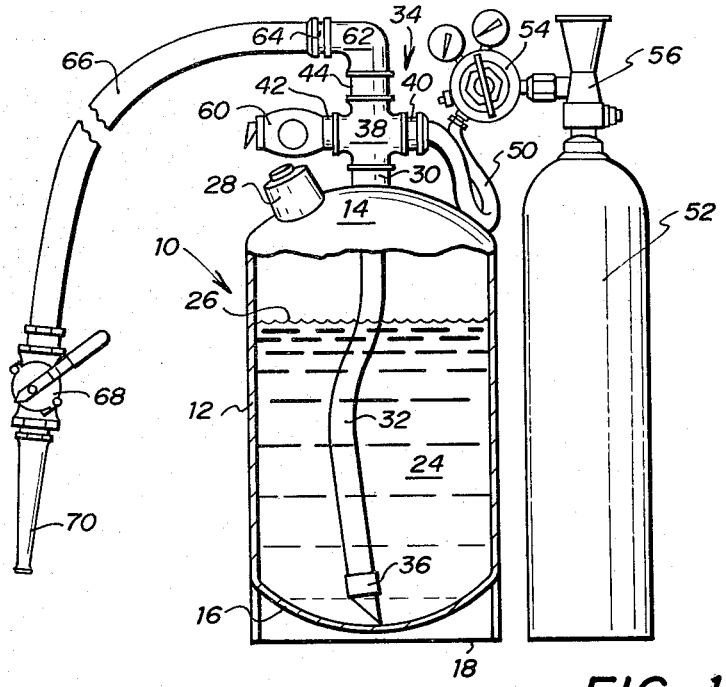
FIG. 1 is a side elevational view, partially in section, of the foam generating fire fighting device of the present invention.

FIG. 1 illustrates the present foam generating fire fighting device and is generally identified by the numeral 10. Foam generating device 10 includes a tank 12 leak tightly sealed at either end to an upper header 14 and a lower header 16. Tank 12 and headers 14 and 16 are constructed of materials impervious to or protected from the foam generating solution stored therein. The lower end of tank 12 includes a base 18. Tank 12 includes a foam generating solution 24 filled to a level indicated at 26. Foam generating solution 24 for use in the present foam generating device 10, is selected depending upon the type of fire to be extinguished.

Connected to header 14 is a fitting 30 for receiving and interconnecting an ejector tube 32 and foam generating assembly, generally identified by the numeral 34, to tank 12. Ejector tube 32 includes a weight 36 for maintaining ejector tube 32 centrally disposed within tank 12. Upper header 14 also includes a port 28 for filling and draining foam generating solution 24 from tank 12.

Foam generating assembly 34 includes a T-connector 38 interconnected to fitting 30. T-connector 38 receives fittings 40, 42 and 44. Fitting 40 is interconnected to hose 50. As shown in FIG. 1, hose 50 is interconnected to a pressure tank 52 through a regulator 54 and a valve assembly 56 to pressurize tank 12. Pressure tank 52 may contain, for example, nitrogen, carbon dioxide, halogen, freon, compressed air or mixtures thereof for maintaining foam generating solution 24 under constant pressure within tank 12. Alternatively, conventional water pump lines such as supplied from fire fighting tank trucks can be interconnected to hose 50 for pressurizing tank 12.

Fitting 42 of T-connector 38 is interconnected to a pressure release valve 60. Fitting 44 is interconnected to an elbow section 62 that receives a fitting 64. Fitting 64 is interconnected to a discharge hose 66. Foam is discharged from discharge hose 66 to a control valve 68 and a nozzle 70. Control valve 68 and nozzle 70 are conventional devices well-known to those skilled in the art.

Figure 2:
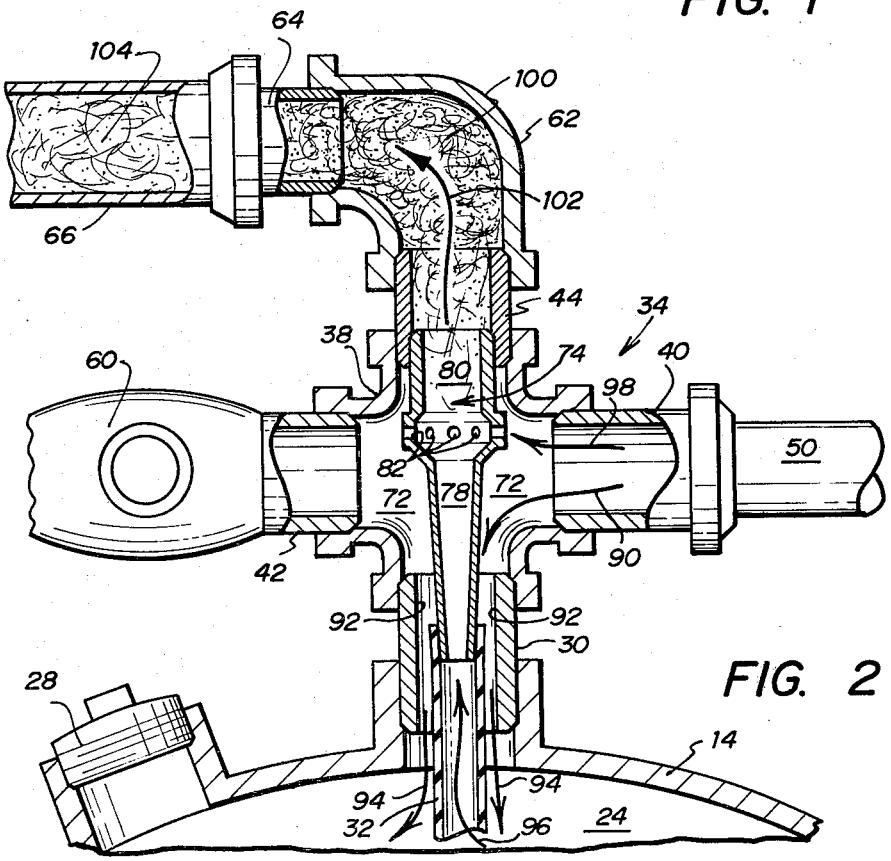
FIG. 2 is a sectional view taken in the same plane of FIG. 1 of the foam generating structure of the present foam generating fire fighting device.

Referring simultaneously to FIGS. 1 and 2 wherein like numerals are utilized for like and corresponding elements, it can be seen that T-connector 38 joins fittings 30, 40, 42 and 44 and defines a cavity 72. Disposed within cavity 72 and interconnecting fittings 30 and 44 is an aeration chamber, generally identified by the numeral 74. Aeration chamber 74 includes a stem portion 78 for insertion through fitting 30 for frictionally receiving ejector tube 32. Aeration chamber 74 further includes a threaded portion 80 for interconnecting aeration chamber 74 to fitting 44. An important aspect of the present invention are apertures 82 disposed circumferentially and centrally around aeration chamber 74. Apertures 82 function to introduce propellant or air into the flow of foam generating solution 24 between tank 12 and discharge hose 66 to aerate foam generating solution 24 to thereby produce foam.

In operation of the present foam generating fire fighting device 10, propellant in the form of compressed air or compressed gas enters cavity 72 from a pressure source indicated by flow directional arrow 90. The propellant then flows through passage ways 92 defined between fitting 30 and stem portion 78 of aeration chamber 74. The flow of propellant in tank 12 is indicated by flow directional arrows 94. As a result of propellant entering tank 12, an increase in pressure is experienced by the foam generating solution 24 within tank 12 such that the foam generating solution 24 is forced into ejector tube 32 as indicated by flow directional arrow 96. Foam generating solution 24 therefore flows through ejector tube 32, through stem portion 78 and threaded portion 80 of aeration chamber 74, through fitting 44 to discharge tube 66.

Propellant from pressure tank 52 also flows through apertures 82 of aeration chamber 74 indicated by directional arrow 98. Propellant, introduced through apertures 82 into the flow stream of foam generating solution 24 passing from tank 12 to discharge tube 66, generates a foam-air or gas slurry 100 present in elbow 62 and indicated by flow directional arrow 102. The foam-air slurry 100 then passes through fitting 64 into discharge tube 66. The foam-air slurry 100 is then highly agitated by the turbulence and back pressure created within discharge tube 66 to form foam 104 for discharge through nozzle 70 (FIG. 1). The size of discharge tube 66 can be selected to obtain foam of desired volume and fluidity.

It therefore can be seen that a single source of propellant is utilized for forcing foam generating solution 24 from tank 12 and also for aerating foam generating solution 24 to produce foam 104. Foam generating solution 24 passing through aeration chamber 74 is thoroughly aerated due to the apertures 82 that permit communication between a propellant and foam generating solution 24. The number and size of apertures 82 is dependent upon the expansion factor desired for the generated foam as determined by the particular foam application.

While the present foam generating fire fighting device has been illustrated and described as being portable, additionally, the device can be permanently affixed to mobile vehicles, such as fire fighting trucks. Foam generating assembly 34 can be interconnected for in-line operation using a conventional fire hose supplied by a fire fighting truck pumping system including a foam solution. Fittings 30 and 44 would be interconnected directly into the fire hose and fitting 42 would be closed for in-line operation. The system can also be utilized in a fixed system to protect buildings and stationary equipment.

While only one embodiment of the present invention has been described in detail herein and shown in the accompanying drawings, it will be evident that various further modifications are possible without departing from the scope of the invention.

I claim:

1. An apparatus for generating and discharging foam comprising:

a container for storing a liquid foam generating solution and for receiving a gaseous propellant;

a propellant supply chamber connected to and communicating with the interior of said container at a location exterior of the container and above the surface of said liquid foam generating solution;

propellant supply means for storing said gaseous propellant attached to and communicating with said propellant supply chamber for pressurizing said propellant supply chamber and said container;

an aeration chamber having a plurality of apertures therein and attached to said propellant supply chamber, such that said aeration chamber communicates with said propellant supply chamber through said plurality of apertures to receive said gaseous propellant;

ejector means having a receiving end and a discharging end, said ejector means being disposed such that said receiving end of said ejector means contacts said liquid foam generating solution within said container, said discharging end of said ejector means being attached to said aeration chamber, such that said ejector means forms a fluid tight passageway for transporting said liquid foam generating solution to said aeration chamber, wherein said gaseous propellant entering said aeration chamber through said plurality of apertures aerates and agitates said liquid foam generating solution to produce an aerated liquid foam generating solution; and a discharge tube having a receiving end and a discharging end, said receiving end of said discharge tube connected to said aeration chamber to receive said aerated liquid foam generating solution, wherein said discharge tube transports and further agitates said aerated liquid foam generating solution to thereby produce foam at said discharging end of said discharge tube.

2. The apparatus for generating and discharging foam of claim 1 wherein said aeration chamber comprises a tubular walled body disposed within said propellant supply chamber, said plurality of apertures being disposed circumferentially and centrally around the walls of said tubular body.

3. The apparatus for generating and discharging foam of claim 2 wherein said tubular body is of varying diameter having a first and second end, wherein said first end is attached to and communicates with said discharging end of said ejector means and said second end is attached to and communicates with said receiving end of said discharge tube and wherein said first end is of a smaller diameter than said second end.

4. The apparatus for generating and discharging foam of claim 3 wherein said gaseous propellant comprises nitrogen.

5. The apparatus for generating and discharging foam of claim 3 wherein said gaseous propellant is selected from the group consisting of compressed air, carbon dioxide, halogen, freon or mixtures thereof.

6. An apparatus for generating and discharging foam comprising:

a container for storing a liquid foam generating solution;

ejector means having a receive end and a discharge end, said ejector means being disposed such that said receive end receives said liquid foam generating solution and such that said discharge end of said ejector means is disposed exterior of said container;

aeration means attached to said discharge end of said ejector means for introducing a gaseous aeration agent into said liquid foam generating solution thereby producing an aerated liquid foam generating solution;

said aeration means comprises a tubular walled body having a plurality of apertures therein disposed within the flow path of said liquid foam generating solution at said discharge end of said ejector means, said plurality of apertures being disposed circumferentially and centrally around the walls of said tubular body; and foam generating hose means for producing foam from said aerated liquid foam generating solution having a discharge end and a receiving end, said receiving end being attached to said aeration means to receive said aerated liquid foam generating solution such that foam production occurs between said receive end and said discharge end of said foam generating hose means through back pressure and frictional turbulence within said foam generating hose means, said foam generating hose means being of sufficient length and cross-section to produce foam of a desired volume and fluidity.

7. The apparatus for generating and discharging foam of claim 6 wherein said gaseous aeration agent comprises nitrogen.

8. The apparatus for generating and discharging foam of claim 6 wherein said gaseous aeration agent is selected from the group consisting of compressed air, carbon dioxide, halogen, freon or mixtures thereof.

9. An apparatus for generating and discharging foam comprising:

a container for storing a liquid foam generating solution;

ejector means having a receive end and a discharge end, said ejector means being disposed such that said receive end receives said liquid foam generating solution and such that said discharge end of said ejector means is disposed exterior of said container;

aeration means attached to said discharge end of said ejector means for introducing a gaseous aeration agent into said liquid foam generating solution thereby producing an aerated liquid foam generating solution;

said aeration means comprises means having at least one aperture therein disposed within the flow path of said liquid foam generating solution at said discharge end of said ejector means; and foam generating hose means for producing foam from said aerated liquid foam generating solution having a discharge end and a receiving end, said receiving end being attached to said aeration means to receive said aerated liquid foam generating solution such that foam production occurs between said receive end and said discharge end of said foam generating hose means through back pressure and frictional turbulence within said foam generating hose means, said foam generating hose means being of sufficient length and cross-section to produce foam of a desired volume and fluidity.

* * * * *